US009494367B2

(12) United States Patent
Gaiser

(10) Patent No.: US 9,494,367 B2
(45) Date of Patent: Nov. 15, 2016

(54) FINNED TUBE HEAT TRANSFER DEVICE

(75) Inventor: Gerd Gaiser, Reutlingen (DE)

(73) Assignee: Eberspächer Exhaust Technology GMBH & CO. KG, Neunkirchen (DE)

( * ) Notice: Subject to any disclaimer, the term of this patent is extended or adjusted under 35 U.S.C. 154(b) by 890 days.

(21) Appl. No.: 13/364,635

(22) Filed: Feb. 2, 2012

(65) Prior Publication Data

US 2012/0199327 A1 Aug. 9, 2012

(30) Foreign Application Priority Data

Feb. 3, 2011 (DE) ..... 10 2011 003 609

(51) Int. Cl.
*F28D 1/053* (2006.01)
*F28F 1/32* (2006.01)

(52) U.S. Cl.
CPC ..... *F28D 1/05341* (2013.01); *F28D 1/05391* (2013.01); *F28F 1/32* (2013.01)

(58) Field of Classification Search
CPC ..... F28D 9/0043; F28D 1/05341; F28D 1/05391; F28D 1/32; F28F 9/22; F28F 1/32
USPC ..... 165/157, 160, 164, 166, 150, 151
See application file for complete search history.

(56) References Cited

U.S. PATENT DOCUMENTS 2,028,455 A * 1/1936 Karmazin ..... 165/150
2,028,456 A * 1/1936 Karmazin ..... 165/150
2,064,036 A * 12/1936 Sandberg ..... 29/890.07
2,950,092 A * 8/1960 Di Niro ..... 165/172
3,430,692 A * 3/1969 Karmazin ..... 165/134.1
3,430,693 A 3/1969 Egenvall
4,836,277 A * 6/1989 Koehler ..... 165/151
D304,855 S * 11/1989 Aoki ..... D23/386
5,505,254 A * 4/1996 Chiba ..... F28D 1/05341 165/148
5,524,707 A * 6/1996 Fredrich ..... 165/79
6,435,273 B1 8/2002 Futernik
2004/0188076 A1* 9/2004 Lee ..... F28D 1/0478 165/174
2006/0090888 A1* 5/2006 Huang ..... F28D 1/024 165/174
2008/0078532 A1* 4/2008 Nagashima et al. ..... 165/104.34
2010/0170664 A1* 7/2010 Vaisman et al. ..... 165/151

FOREIGN PATENT DOCUMENTS

DE 11 2005 000 797 T5 3/2007
EP 2 131 131 A1 12/2009
JP 2004-317056 A 11/2004
JP 2007 298260 A 11/2007

* cited by examiner

*Primary Examiner* — Tho V Duong
*Assistant Examiner* — Raheena Rehman
(74) *Attorney, Agent, or Firm* — McGlew and Tuttle, P.C.

(57) ABSTRACT

A finned-tube heat transfer device (1) has a housing (2) enclosing a first flow path (3) for a first fluid with a first inlet (4) and a first outlet (5). A tube system (9) forms a second flow path (10) for a second fluid with a second inlet (11) and a second outlet (12) and which is coupled to the first flow path (3) in the housing (2) in a heat transferring manner. The tube system (9) has a multitude of tubes (13) that are parallel to one another, which extend between two housing walls (7) laterally delimiting the first flow path (3). The tubes are provided with fins (14), within the first flow path (3), which are fluidically interconnected outside the first flow path (3). A simplified producability can be achieved if the fluidic connection of the tubes (13) is effected within the two housing walls (7).

19 Claims, 6 Drawing Sheets

FINNED TUBE HEAT TRANSFER DEVICE

CROSS REFERENCE TO RELATED APPLICATIONS

This application claims the benefit of priority under 35 U.S.C. §119 of German Patent Application DE 10 2011 003 609.1 filed Feb. 3, 2011, the entire contents of which are incorporated herein by reference.

FIELD OF THE INVENTION

The present invention relates to a finned-tube heat transfer device, in particular for vehicle applications. The present invention additionally relates to a process using such a finned-tube heat transfer device.

BACKGROUND OF THE INVENTION

Finned-tube heat transfer devices are characterized by a multitude of parallel tubes which are provided with fins, wherein the fins and the tubes are exposed to and externally circulated by a first fluid and the tubes are subjected to a second fluid through-flow.

In detail, such a finned-tube heat transfer device can comprise a housing enclosing a first flow path for a first fluid and which comprises a first inlet for the first fluid as well as first outlet for the first fluid. Furthermore, such a finned-tube heat transfer device typically comprises a tube system forming a second flow path for a second fluid, which comprises a second inlet for the second fluid and a second outlet for the second fluid and which in the housing is coupled to the first flow path in a heat-transferring manner. The tube system now comprises a multitude of tubes which are parallel to one another, which extend between two housing walls laterally delimiting the first flow path and which are provided with fins within the first flow path. The tubes are fluidically interconnected outside the first flow path.

In order to fluidically interconnect the tubes outside the first flow path it is possible in principle to pass the tubes through the mentioned housing walls and connect these on an outside facing away from the first flow path using U-shaped connecting pieces. Such a design is comparatively expensive to produce. Apart from this, the design freedom is restricted since the U-shaped connecting pieces regularly produced through bending forming have to adhere to a minimum bending radius for stability reasons.

SUMMARY OF THE INVENTION

The present invention deals with the problem of providing an improved embodiment for a finned-tube heat transfer device of the type mentioned at the outset, which is more preferably characterized in that it can be produced comparatively easily and/or has an improved design freedom.

According to the invention, a finned-tube heat transfer device, more preferably for vehicle applications, is provided with a housing enclosing a first flow path in the circumferential direction with the first flow path penetrating the housing in the longitudinal direction of the housing. The housing at its longitudinal ends comprises a first inlet for the first fluid and a first outlet for the first fluid. A tube system forms a second flow path for a second fluid, which comprises a second inlet for the second fluid and a second outlet for the second fluid and which is arranged in the first flow path and is coupled in the housing to the first flow path in a heat transferring manner. The tube system comprises a multitude of tubes which are parallel to one another, which extend between two housing walls laterally delimiting the first flow path and which within the first flow path are provided with fins. The tubes are fluidically interconnected outside the first flow path. The fluidic connection of the tubes is effected within the two housing walls.

The invention is based on the general idea of fluidically interconnecting the tubes within the two housing walls. Through the integration of the fluidic connections in the two housing walls, a multitude of individual, separate connecting pieces can be omitted, which reduces the assembly costs. In addition, advantages with regard to the design freedom are achieved, since no bending radii of connecting pieces have to be considered. In particular, the finned-tube heat transfer device according to the invention is suitable for a cost-effective series production, for example for vehicle applications. Particularly advantageously, the invention can be realized with a finned tube heat transfer device, with which the first flow path penetrates the housing in a longitudinal direction of the housing and with which the first flow path is enclosed by walls of the housing in the circumferential direction of the housing, quasi tunnel-like. A first inlet of the first flow path and a first outlet of the first flow path in this case are formed on longitudinal ends of the housing. The second flow path is in this case arranged with its tubes and its fins in the first flow path and accordingly circulated by (and in heat transfer contact with) the first fluid. The two housing walls, in which the tubes are fluidically interconnected, are located opposite each other on the first flow path and can in particular be interconnected at their lateral margins via two further housing walls, which are likewise located opposite each other on the first flow path.

According to an advantageous embodiment, the two housing walls can contain hollow spaces, which are fluidically connected with the respective tubes. The hollow spaces then realise the fluidic connection of those tubes, which are connected to the respective hollow space.

An embodiment that can be realized particularly cost-effectively is characterized in that the respective housing wall is of a double-walled design and comprises an inner wall facing the first flow path and an outer wall facing away from the first flow path. The fluidic connection of the tubes is then effected between inner wall and outer wall, i.e. within the double-walled housing wall, which can also be called double wall in the following.

Practically, the tubes can penetrate the respective inner wall and bend in hollow spaces, which are formed between inner wall and outer wall. Such an embodiment can be produced particularly easily and cost-effectively. For example, the tubes can penetrate the inner wall in conventional manner and be tightly fastened to said inner wall. Instead of assembling a multitude of separate connecting pieces, the respective outer wall can in this case be simply assembled to the inner wall in order to form all required fluidic connections in a single operation.

Practically, the hollow spaces which are formed between inner wall and outer wall can be exclusively formed in the outer wall, for example through deep-drawing or stamping. The hollow spaces formed in the outer wall are closed through the inner wall in the assembled state, which in contrast to the outer wall can be preferentially configured flat.

The hollow spaces are formed in the respective outer wall in the form of depressions which are open towards the inner wall. In the assembled state, however, the inner wall closes off the depressions, as a result of which the hollow spaces are formed within the double-walled housing wall. The depressions can be produced in the outer wall for example through stamping, through deep-drawing, through pressing, in particular through extruding, through spin-forming or through any other suitable forming process. In addition to these forming processes, which can be realized comparatively cost-effectively, cutting methods or casting methods are also conceivable in principle, which, however, are unsuitable for series production because of the higher costs.

According to an advantageous embodiment, the hollow spaces can form connecting channels each of which connect an exit end of a single tube with an entry end of a single other tube. These connecting channels then represent individual connecting pieces, each of which interconnect exactly two tubes. This can be advantageous for certain configurations for finned-tube heat transfer devices.

It is likewise possible, alternatively, to configure the hollow spaces so that they form connecting chambers, each of which connect the exit ends of a plurality of tubes to the entry ends of a plurality of other tubes. Within such connecting chambers, a homogenization with respect to the temperature within the second fluid can take place, which can be advantageous with certain applications of such finned-tube heat transfer devices.

With another embodiment, the outer wall can bear against the inner wall in a flat manner or be fastened to said inner wall in a flat manner. For example, outer wall and inner wall can be soldered to each other or welded to each other. Alternatively, the outer wall can be flat in contact with or fastened to the inner wall in a line-shaped manner. Particularly suited for this is a welded connection, with which a line-shaped weld seam can be particularly easily realized. Flat contacting can also be combined with a line-shaped fastening.

Practically, the respective inner tube can have tube openings each of which are penetrated by a single tube. Thus, each individual tube has to be ultimately fastened to the inner wall. In particular, the tube openings can each be designed with a circumferential collar or without collar. Similarly, the tube openings can each be designed as passage. The collarless configuration can be realized particularly cost-effectively. An embodiment with circumferential collar on the respective tube opening or with a passage on the respective tube opening simplifies the manufacture of a welded connection or a soldered connection between the respective inserted tube and the inner wall.

While each of the tubes are fastened to the respective inner wall, in particular welded or soldered, it can be provided according to an advantageous embodiment that the tubes do not touch the respective outer wall. This simplifies realizing the hollow spaces between the inner wall and the outer wall.

For finning the tubes there are different possibilities, each of which can be advantageous depending on the application of the finned-tube heat transfer device. For example, each tube can have its own fins within the first flow path. Alternatively it can be provided that a plurality of tubes has common fins within the first flow path. Furthermore, it is likewise possible that all tubes within the first flow path have common fins. The use of common fins leads to a particularly intensive stiffening of the tube system within the first flow path.

Insofar as all tubes are assigned common fins, these fins can run parallel and/or congruent with the two housing walls in the manner of lamellae. This produces an effective and low-resistance flow guidance for the first fluid in the first flow path.

According to another advantageous embodiment, the second fluid inlet, via which the second fluid enters the tube system, can be formed on one of the two housing walls so that the second fluid inlet is located outside the first flow path and is comparatively easily accessible. Here it can be more preferably provided that the respective housing wall comprises a hollow space designed as distribution chamber, which fluidically connects the entry ends of a plurality of tubes to the second fluid inlet.

In addition or alternatively, the second fluid outlet, through which the second fluid exits the tube system, can be formed on one of the two housing walls and, accordingly, be arranged outside the first fluid path and, accordingly, be easily accessible. In this case, too, it can be practically provided that the respective housing wall comprises a hollow space designed as collecting chamber, which fluidically connects the exit ends of a plurality of tubes to the second fluid outlet.

According to another practical embodiment, the tubes are arranged next to one another in lines running transversely to the flow direction of the first fluid. Practically, the tubes can in this case be aligned in lines, which follow in succession in the flow direction of the first fluid or be arranged offset to one another transversely to the flow direction of the first fluid. While the aligned arrangement offers a reduced flow resistance, the offset arrangement leads to an improved heat transfer.

The tubes can have a circular cross section or an oval cross section or an elliptical cross section. In principle, other cross-sectional geometries are also conceivable, which have shapes other than round. An advantageous embodiment results with the tubes extending transversely to the longitudinal direction of the housing through the first flow path and being arranged parallel next to one another both in the longitudinal direction as well as the transverse direction of the housing. This produces a particularly compact design, which can transfer a lot of heat in a small space.

Additionally or alternative it can be provided that the fluidic connections of the tubes are realized such that a plurality of tube groups connected in parallel are formed, each of which comprises a plurality of tubes connected in series. In this way, relatively large flow rates with comparatively little flow resistance can be realized in the second flow path despite comparatively small flow cross sections of the individual tubes.

Particularly advantageously, the finned-tube heat transfer device introduced In this case can be employed as exhaust gas heat transfer device or as evaporator or as exhaust gas recirculation cooler or as charge air cooler or as heater heat transfer device or as evaporator or condenser of an air-conditioning device or as evaporator or condenser of a waste heat utilization device based on a Rankine cycle process, each more preferably in a motor vehicle.

Further important features and advantages of the invention are obtained from the subclaims, from the drawings and from the associated Figure description by means of the drawings.

It is to be understood that the features mentioned above and still to be explained in the following cannot only be used in the respective combination stated, but also in other combinations or by themselves without leaving the scope of the present invention.

Preferred exemplary embodiments of the invention are shown in the drawing and are explained in more detail in the following description, wherein same reference characters refer to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
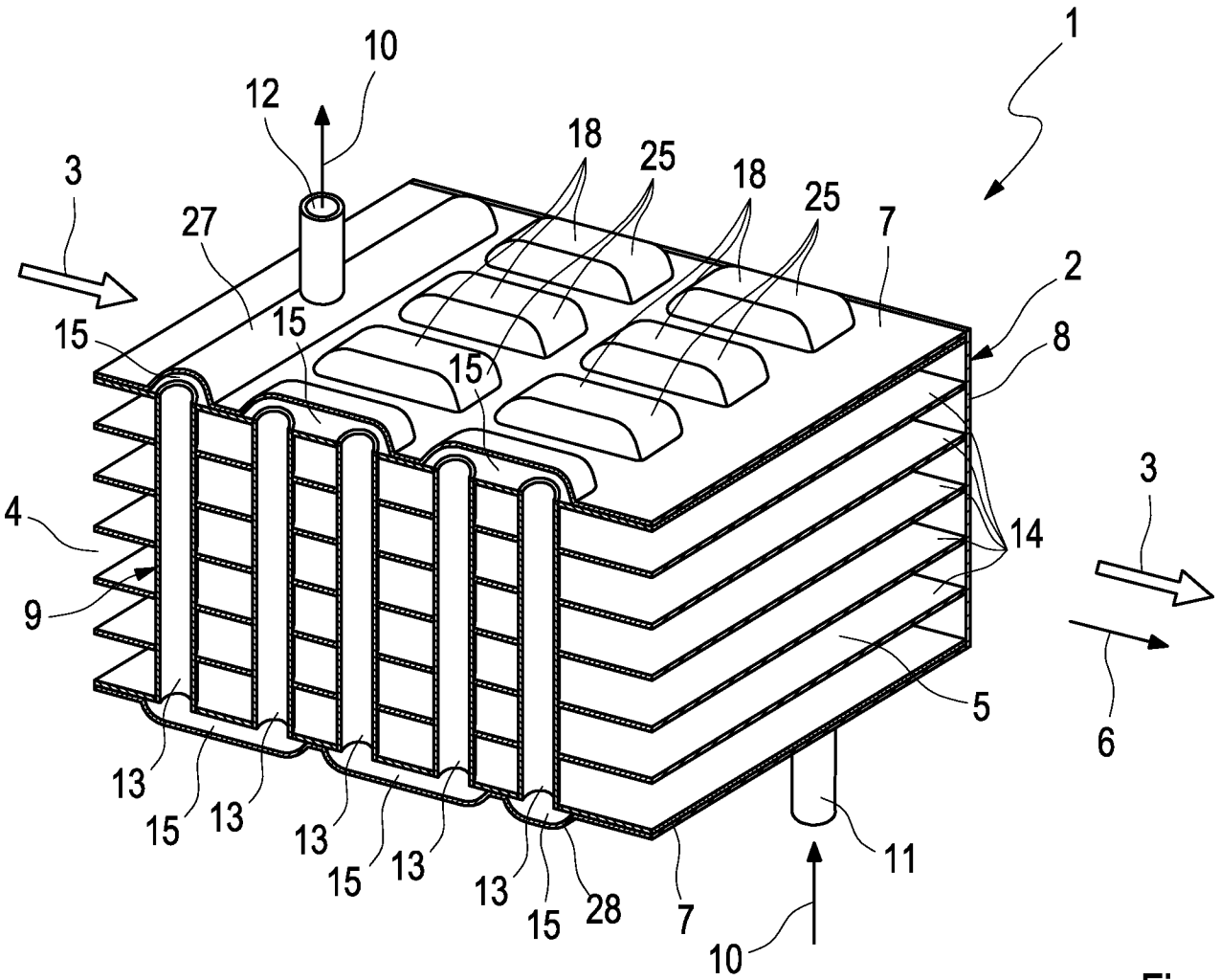
FIG. 1 is a highly simplified, sectioned isometric schematic representation of a finned-tube heat transfer device.
Figure 2:
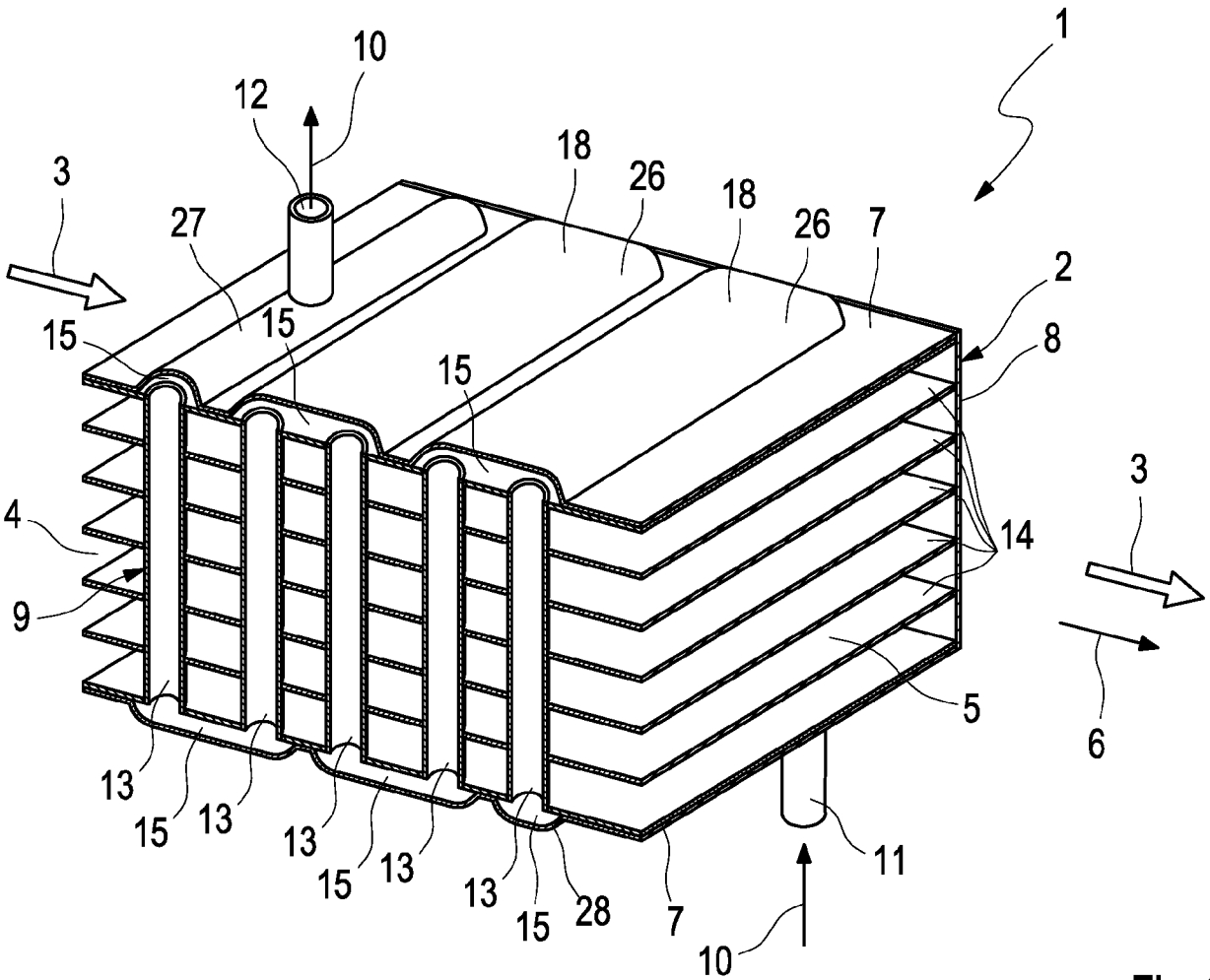
FIG. 2 is a view as in FIG. 1, however with another embodiment of the finned-tube heat transfer device.

Referring to the drawings in particular, according to FIGS. 1 and 2, a finned-tube heat transfer device 1, which can be employed for example in a vehicle, comprises a housing 2, which encloses a first flow path 3 indicated by arrows for a first fluid, preferentially a gas, and which comprises a first inlet 4 for the first fluid and a first outlet 5 for the first fluid. The housing 2 in this case encloses the first flow path 3 transversely to a flow direction 6 of the first fluid within the housing 2. To this end, the housing 2 comprises two housing walls 7 spaced from each other and two further housing walls 8, which are likewise arranged spaced from each other and which interconnect the two other housing walls 7. Of the further housing walls 8, only the one is noticeable in the FIGS. 1 and 2 because of the sectional view. In the example, all housing walls 7, 8 are substantially configured flat, as a result of which the housing 2 has a substantially rectangular cross section. Other cross-sectional geometries are also conceivable in principle.

The finned-tube heat transfer device 1 additionally comprises a tube system 9, which forms a second flow path 10 likewise indicated by arrows for a second fluid, which is preferentially liquid. The tube system 9 comprises a second inlet 11 for the second fluid and a second outlet 12 for the second fluid. The tube system 9 is coupled to the first flow paths 3 in a heat transferring manner in the interior of the housing 2.

The tube system 9 comprises a multitude of tubes 13, which run parallel to one another and in this case extend between the two housing walls 7. In this case, the tubes 13 extend perpendicularly to the planes of the housing walls 7 and perpendicularly to the flow direction 6 of the first fluid. Thus, the tubes 13 extend through the first flow paths 3 so that they are exposed to or circulated by the first fluid 3. In order to improve the heat transfer between first fluid and second fluid, the tubes 13 are provided with fins 14 within the first flow path 3.

For realizing the second flow path 10, the tubes 13 are fluidically interconnected in a suitable manner. This fluidic connection of the tube 13 in this case is effected outside the first flow path 3, namely within the two housing walls 7. To this end, hollow spaces 15 are provided in the housing walls 7, which are fluidically connected to the tubes 13.

Figure 3:
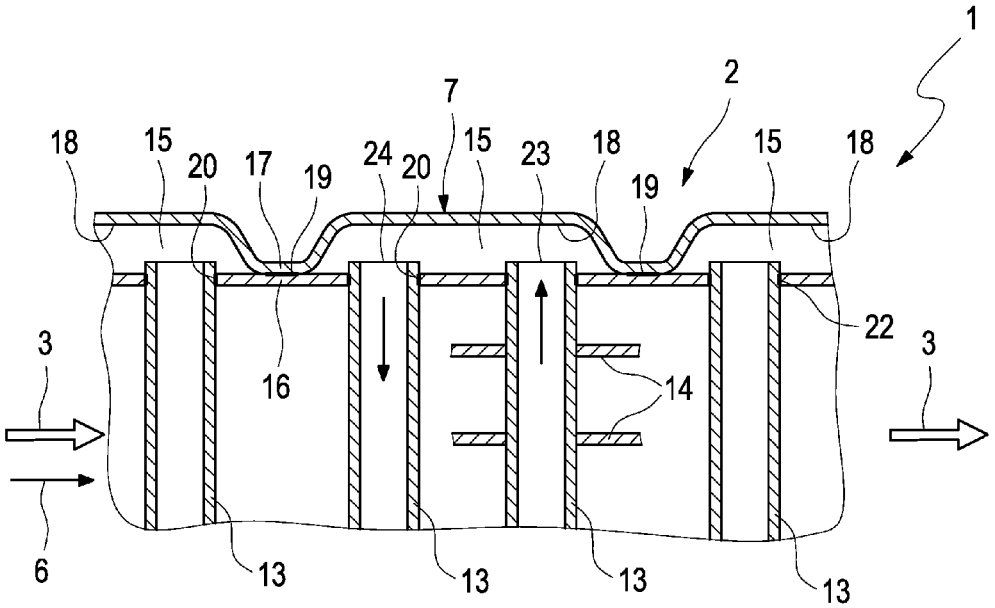
FIG. 3 is a longitudinal sectional view of the finned-tube heat transfer device in the region of a housing wall.
Figure 4:
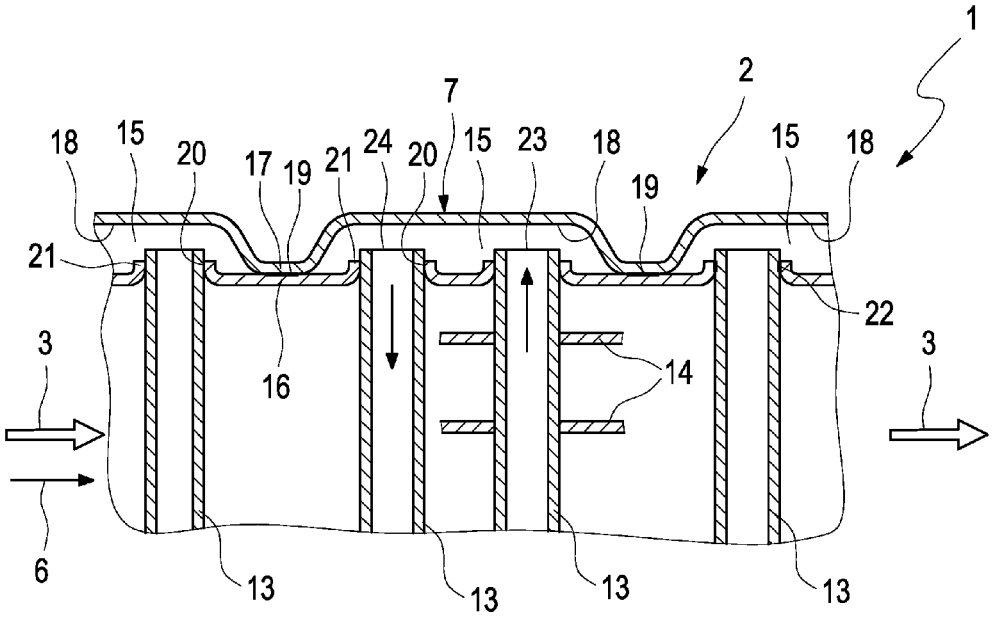
FIG. 4 is a longitudinal sectional view as in FIG. 3, however with another embodiment.

According to the FIGS. 3 and 4, the respective housing wall 7 can be designed double-walled according to a preferred embodiment, so that it comprises an inner wall 16 facing the first flow paths 3 and an outer wall 17 facing away from the first flow path 3. The fluidic connection between the respective tubes 13 in this case is effected between inner wall 16 and outer wall 17, i.e. within the double-walled housing wall 7. To this end, the tubes 13 penetrate the inner wall 16 and end in the hollow spaces 15, which are formed between inner wall 16 and outer wall 17. In the following, the double-walled housing walls can also be called double walls 7, while the further housing walls 8 can also be called side walls 8 in the following, which preferentially are designed as simple walls.

Practically, the hollow spaces 15 are produced in that depressions 18 are formed in the outer wall 17, which are open towards the inner wall 16 and which in the assembled state of the housing wall 7 are closed off by the inner wall 16. For example, the depressions 18 are produced in the outer wall 17 through forming. Because of this, the outer wall 17 has a dent-like structure, wherein the outer wall 17 continues to extend in a plane. In contrast with this, the inner wall 16 is practically designed flat. According to the FIGS. 3 and 4, the depressions 18 are so arranged in the outer wall 17 that flat contact zones 19 are formed, in which the outer wall 17 bears against the inner wall 16 in a flat and preferentially tight manner. In the region of this contact zone 19, outer wall 17 and inner wall 16 can also be fastened to each other, for example via an areal soldered connection. Alternatively, a line-shaped welded connection can also run in the region of the contact zone 19. Likewise, the contact zones 19 can be configured line-shaped.

The inner wall 16 has tube openings 20, through which the tubes 13 are passed. In this case, each tube 13 penetrates each tube opening 20. In the example of FIG. 3, the tube openings 20 are designed collarless, as a result of which they can be produced particularly easily for example through a punching operation. In contrast with this, FIG. 4 shows an embodiment wherein the tube openings 20 are configured as passages so that they comprise a circumferential collar 21 each. The tubes 13 are each fastened to the inner wall 16. To this end, closed circulating connecting points 22 can be formed about the respective tube 13, which for example can be designed as welded connections or as soldered connections. The arrangement of the tubes 13 in this case is effected such that they do not touch the respective outer wall 17. Accordingly, the tubes 13 end within the hollow spaces 15 spaced from the outer wall 17.

According to FIGS. 3 and 4, the respective hollow space 15 connects an exit end 23 of at least one tube 13 to an entry end 24 of at least one other tube 13. According to FIG. 1 it can be provided that the hollow spaces 15 form connecting channels 25, which each connect the exit end 23 of a single tube 13 to the entry end 24 of a single other tube 13. Because of this, the tubes 13, which with respect to the flow direction 6 of the first fluid are transversely adjacent, are fluidically decoupled from one another.

Alternatively to this, FIG. 2 shows an embodiment wherein the hollow spaces 15 form connecting chambers 26, which each connect the exit ends 23 of a plurality of tubes 13 to the entry ends 24 of a plurality of other tubes 13. Because of this, the tubes 13, which are adjacent transversely to the flow direction 6 of the first fluid, are fluidically coupled to one another. Because of this, a homogenization of the temperature in the second fluid can be more preferably realized.

FIGS. 1 and 2 additionally show a hollow space 15, which is designed as collecting chamber 27, in which the exit ends 23 of a plurality of tubes 13 adjacent transversely to the flow direction 6 of the first fluid, terminate. To this collecting chamber 27, the second fluid outlet 12 is additionally connected. Accordingly, the collecting chamber 27 connects the mentioned exit ends 23 of the tubes 13 to the second fluid outlet 12. Accordingly, the second fluid outlet 12 in this case is formed on the one housing wall 7. Similar to this, the second fluid inlet 11 is formed on the opposite housing wall 7. In this case, it can be practically provided, that the second fluid inlet 11 is likewise connected to a hollow space 15, which however is configured as distribution chamber 28. A plurality of tubes 13 adjacent transversely to the flow direction 6 of the first fluid 3, whose entry ends 24 are suitably connected to this distribution chamber 28, leave from this distribution chamber 28, Accordingly, the distribution chamber 28 couples the second fluid inlet 11 to the entry ends 24 of the mentioned tubes 13.

Such distribution chambers 28 make possible a parallel interconnection of a plurality of tube groups, which in turn comprise a plurality of series-connected tubes 13 each. Because of this, the flow rate through the second flow path 10 can be increased.

Figure 5A:
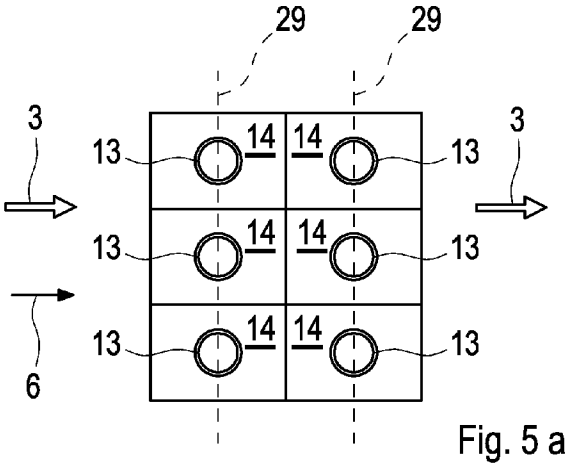
FIG. 5*a* is a highly simplified, schematic sectional view of the finned-tube heat transfer device in the region of a tube system with one of different embodiments.
Figure 5C:
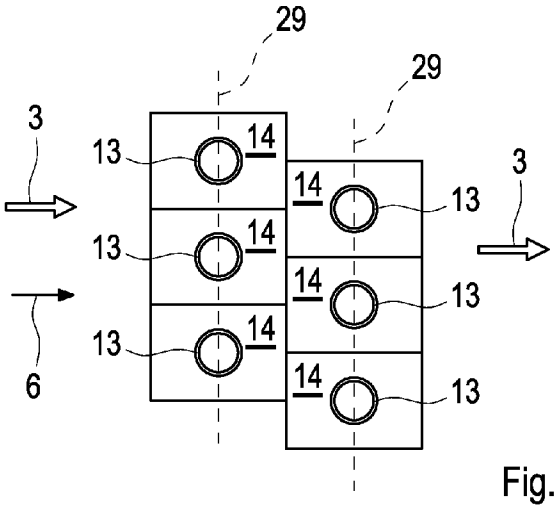
FIG. 5*c* is a highly simplified, schematic sectional view of the finned-tube heat transfer device in the region of a tube system with another of different embodiments.
Figure 5B:
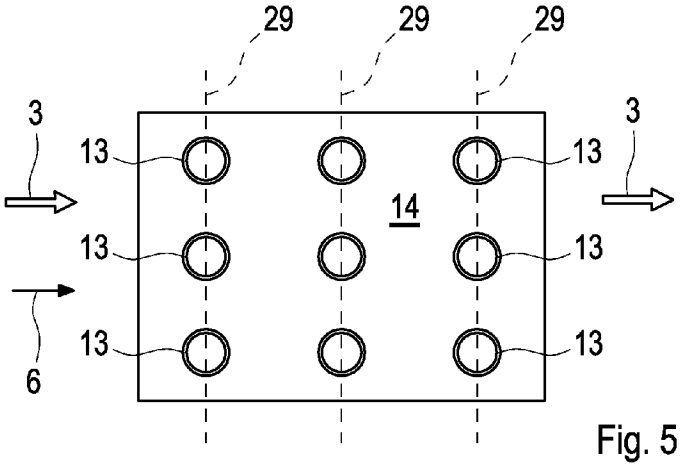
FIG. 5*b* is a highly simplified, schematic sectional view of the finned-tube heat transfer device in the region of a tube system with another of different embodiments.
Figure 5D:
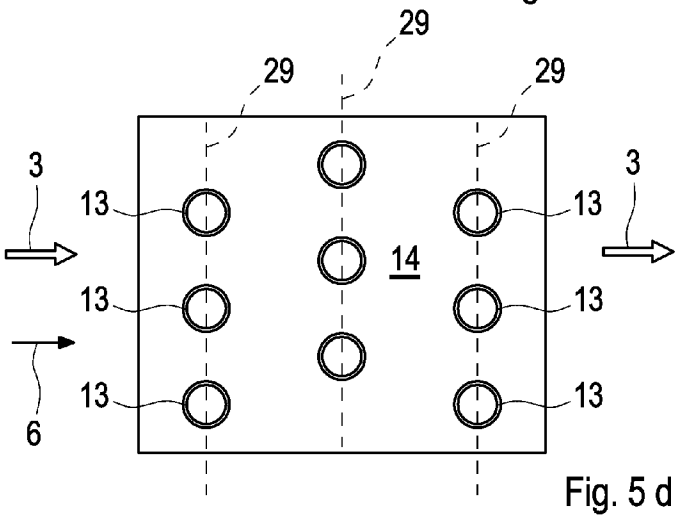
FIG. 5*d* is a highly simplified, schematic sectional view of the finned-tube heat transfer device in the region of a tube system with another of different embodiments.

According to FIGS. 5*a*-5*d* there are different possibilities for the finning of the tubes 13, of which only some are mentioned here purely as examples. For example, according to the FIGS. 5*a* and 5*c*, each tube 13 can have its own fins 14, which follow in succession spaced from one another in the tube longitudinal direction. In this case, the individual fins 14 can extend parallel to the planes of the housing walls 7. Alternatively to this, FIGS. 5 and 5*d* show embodiments, wherein a plurality of tubes 13 in each case comprise common fins 14. The common fins 14 in this case can extend over a plurality of tubes 13 adjacent transversely to the flow direction 6. Likewise, the common fins 14 can extend over a plurality of tubes 13 in succession parallel to the flow direction 6. Likewise, the common fins 14, as in FIGS. 5*b* and 5*d*, can extend both over a plurality of tubes 13 adjacent transversely to the flow direction 6 as well as over a plurality of tubes 13 in succession in the flow direction 6. Alternatively, it can be likewise provided that all tubes 13 have common fins 14 within the first flow path 3, which, accordingly, extend transversely to the flow direction 6 over all adjacent tubes 13 and in the flow direction 6 over all tubes 13 in succession. These large fins 14 can also be called lamellae. Practically, these large fins 14 or lamellae can extend congruently to the two housing walls 7 and parallel thereto.

Figure 6:
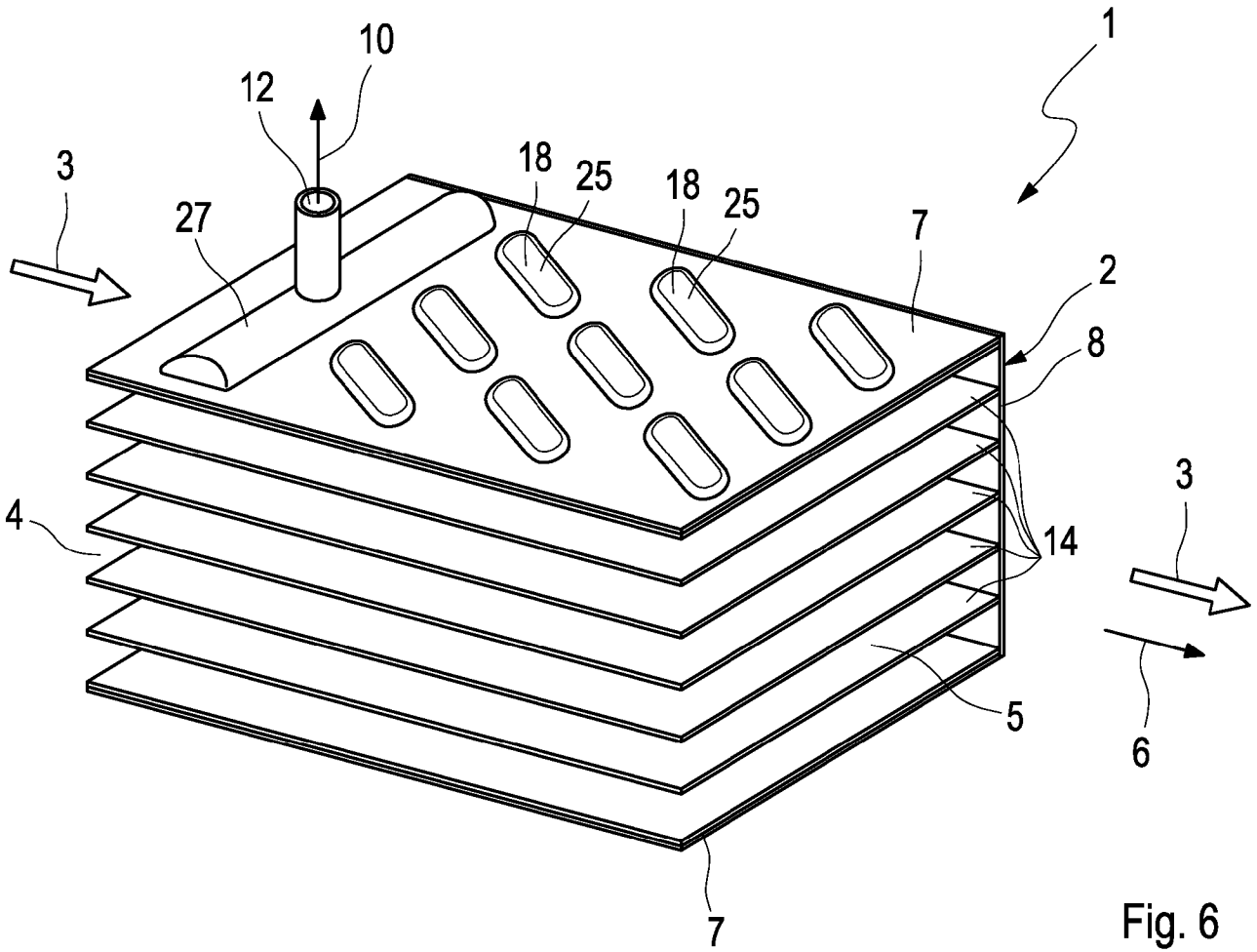
FIG. 6 is a simplified isometric view of the finned-tube heat transfer device as in FIGS. 1 and 2, however with a further embodiment.

As is more preferably evident from the FIGS. 5-7, the tubes 13 can be arranged next to one another in straight lines 29 transversely to the flow direction 6 of the first fluid. Furthermore, the tubes 13 according to the embodiments of FIGS. 5*a*, 5*b*, 7*a* and 7*c* can be in alignment with one another in lines 29, which directly follow in succession in the flow direction 6 of the first fluid, so that they also directly follow one another parallel to the flow direction 6 of the first fluid in straight lines which are not shown. Alternatively to this, the tubes 13 according to FIGS. 5*c*, 5*d*, 6, 7*b* and 7*d* can be arranged offset to one another transversely to the flow direction 6 of the first fluid in lines 29, which directly follow in succession in the flow direction 6 of the first fluid. Because of this, a compact design finned-tube heat transfer device 1 is realized on the one hand On the other hand, this increases the flow resistance for the first fluid, which can be additionally utilized for an improved heat transfer. For the connecting channels 25, a diagonal arrangement is the result of such a configuration according to FIG. 6.

Figure 7A:
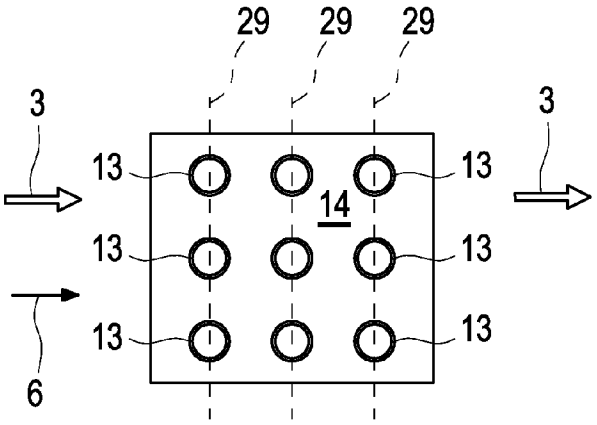
FIG. 7*a* is a highly simplified sectional view of the finned-tube heat transfer device in the region of the tube system with one of different embodiments.
Figure 7B:
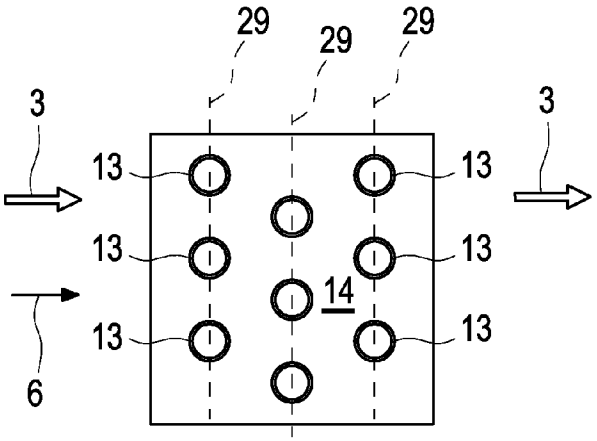
FIG. 7*b* is a highly simplified sectional view of the finned-tube heat transfer device in the region of the tube system with another of different embodiments.
Figure 7C:
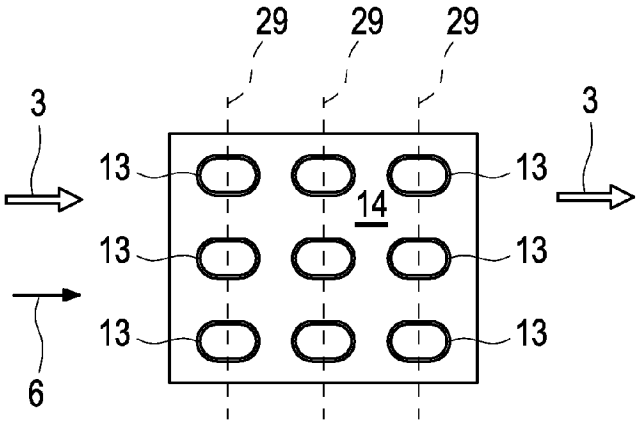
FIG. 7*c* is a highly simplified sectional view of the finned-tube heat transfer device in the region of the tube system with another of different embodiments.
Figure 7D:
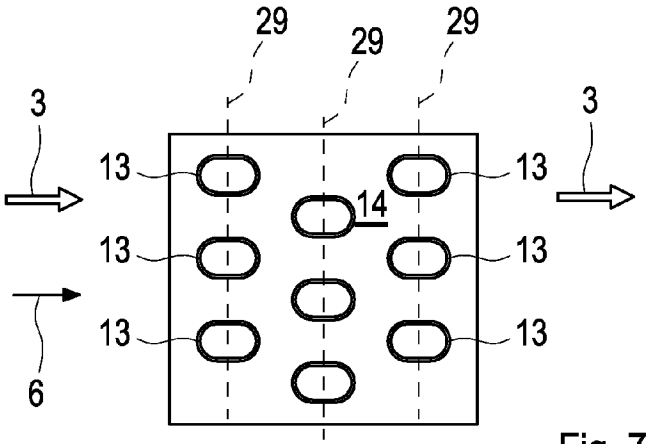
FIG. 7*d* is a highly simplified sectional view of the finned-tube heat transfer device in the region of the tube system with another of different embodiments.

According to FIGS. 7*a*-7*d*, the tubes 13 can have any cross-sectional geometries in principle, while round cross sections are preferred, which make possible cylindrical tubes 13. The FIGS. 7*a* and 7*b* show circular cross sections, while the FIGS. 7*c* and 7*d* show oval cross sections or elliptical cross sections.

While specific embodiments of the invention have been shown and described in detail to illustrate the application of the principles of the invention, it will be understood that the invention may be embodied otherwise without departing from such principles.

What is claimed is:

1. A finned-tube heat transfer device comprising:

a housing enclosing a first flow path in the circumferential direction with the first flow path penetrating the housing in the longitudinal direction of the housing, said housing having longitudinal ends comprising a first inlet for a first fluid and a first outlet for the first fluid, said first flow path being laterally delimited by two housing walls; and a tube system forming a second flow path for a second fluid, said tube system comprising a second inlet for the second fluid and a second outlet for the second fluid, said tube system being arranged in said first flow path and being coupled in said housing to said first flow path in a heat transferring manner and comprising a multitude of tubes, which are parallel to one another, which extend between said two housing walls and which are provided with fins within said first flow path, said tubes being arranged offset to one another transversely to a flow direction of the first fluid, said tubes being fluidically interconnected outside of said first flow path by a fluidic connection of said tubes effected within said two housing walls, said second fluid inlet being formed on one of said two housing walls and said one of the two housing walls comprising a hollow space comprising a distribution chamber, which fluidically connects entry ends of a plurality of said tubes to said second fluid inlet, said second fluid outlet being formed on another one of said two housing walls and said another one of said two housing walls comprises a hollow space comprising a collecting chamber, which fluidically connects exit ends of a plurality of said tubes to said second fluid outlet, one of said two housing walls comprising a first double wall structure, said first double wall structure comprising a first integrally formed one-piece inner wall and a first integrally formed one-piece outer wall, said first housing outer wall comprising a plurality of first connecting channel portions, said first connecting channel portions being diagonally arranged to form a diagonal arrangement of connecting channels, at least one of said plurality of first connecting channel portions being located at a spaced location from another one of said plurality of first connecting channel portions with respect to a first direction of said first housing outer wall, said at least one of said plurality of first connecting channel portions being located at a spaced location from yet another one of said plurality of first connecting channels portions with respect to a second direction of said first housing outer wall, said first direction being different from said second direction, said plurality of first connecting channel portions being integrally connected to said first integrally formed one-piece housing outer wall, another one of said two housing walls comprising a second double wall structure, said second double wall structure comprising a second integrally formed one-piece inner wall and a second integrally formed one-piece outer wall, said second integrally formed one piece outer wall comprising a plurality of second connecting channel portions, at least one of said plurality of second connecting channel portions being located at a spaced location from another one of said plurality of second connecting channel portions with respect to a second housing outer wall first direction of said second housing outer wall, said at least one of said plurality of second connecting channel portions being located at a spaced location from yet another one of said plurality of second connecting channels portions with respect to a second housing outer wall second direction of said second housing outer wall, said second housing outer wall second direction being different from said second housing outer wall first direction, said plurality of second connecting channel portions being integrally connected to said second integrally formed one-piece outer wall, each of said first connecting channel portions and each of said second connecting channel portions connecting an exit end of one of said tubes to an entry end of another one of said tubes, said second fluid inlet being formed on one of said first integrally formed one-piece outer wall and said second integrally formed one-piece outer wall, one of said first integrally formed one-piece outer wall and said second integrally formed one-piece outer wall and one of a portion of said first integrally formed one-piece inner wall and a portion of said second integrally formed one-piece inner wall defining said distribution chamber, another one of said first integrally formed one-piece outer wall and said second integrally formed one-piece outer wall and another one of said portion of said first integrally formed one-piece inner wall and said portion of said second integrally formed one-piece inner wall defining said collecting chamber, said second fluid outlet being formed on said another one of said first integrally formed one-piece outer wall and said second integrally formed one-piece outer wall.

2. The finned-tube heat transfer device according to claim 1, wherein each of said two housing walls contain hollow spaces fluidically connected to the respective said tubes, said first double wall structure being located opposite said second double wall structure, each of said first connecting channel portions defining an outermost surface of said first housing outer wall, each of said second connecting portions defining an outermost surface of said second housing outer wall, wherein a first planar portion of said first housing outer wall is located between each of said plurality of first connecting channel portions and said another one of said plurality of first connecting channel portions with respect to said first direction of said first housing outer wall and a second planar portion of said first housing outer wall is located between each of said plurality of said first connecting channel portions and said yet another one of said plurality of first connecting channels portions with respect to said second direction of said first housing outer wall, wherein a second housing outer wall first planar portion is located between each of said plurality of second connecting channel portions and said another one of said plurality of second connecting channel portions with respect to said second housing outer wall first direction and a second housing outer wall second planar portion is located between each of said plurality of second connecting channel portions and said yet another one of said plurality of second connecting channels portions with respect to said second housing outer wall second direction.

3. The finned-tube heat transfer device according to claim 1, wherein each of said two housing walls comprises an inner wall facing said first flow path and an outer wall facing away from said first flow path, wherein the respective said tubes are fluidically interconnected between said outer wall and said inner wall, said first flow path being parallel to a longitudinal axis of said two housing walls, wherein said distribution chamber extends in a direction orthogonal to said first flow path, each of said first connecting channel portions defining an outer periphery of said first housing outer wall, each of said second connecting portions defining an outer periphery of said second housing outer wall.

4. The finned-tube heat transfer device according to claim 3, wherein said tubes penetrate the respective said inner wall and end in one of hollow spaces formed between said inner wall and said outer wall, said first connecting channel portions and said second connecting channel portions extending parallel to said first flow path.

5. The finned-tube heat transfer device according to claim 4, wherein said hollow spaces are formed in said outer wall and are closed off by said inner wall, said first direction and said second housing outer wall first direction being parallel to said first flow path, said second direction and said second housing outer wall second direction being perpendicular to said first flow path.

6. The finned-tube heat transfer device according to claim 2, wherein one of:

said hollow spaces each form a connecting channel, each connecting channel connecting an exit end of one of said tubes to an entry end of another one of said tubes; and said hollow spaces each form a connecting chamber, each connecting chamber connecting exit ends of a plurality of said tubes to entry ends of a plurality of other said tubes.

7. The finned-tube heat transfer device according to claim 3, wherein one of:

said first integrally formed one-piece outer wall bears flat against said first integrally formed one-piece inner wall and/or is fastened to said first integrally formed one-piece inner wall in a flat or line-shaped manner; and said first integrally formed one-piece outer wall bears against said first integrally formed one-piece inner wall in the shape of a line and/or is fastened to said first integrally formed one-piece inner wall in the manner of a line.

8. The finned-tube heat transfer device according claim 3, wherein said first integrally formed one-piece inner wall and said second integrally formed one-piece inner wall comprise tube openings, each of which is penetrated by a single tube, wherein said tube openings are configured to be collarless or have a circumferential collar or are configured as passages.

9. The finned-tube heat transfer device according to claim 3, wherein each of said tubes are fastened to a respective said inner wall and do not touch a respective said outer wall.

10. The finned-tube heat transfer device according to claim 1, wherein one of:

each tube of said tubes within said first flow path has fins of said tube's own;

a plurality of said tubes within said first flow path comprise common fins; and all of said tubes within said first flow path comprise fins assigned in common to all of said tubes and run parallel and/or congruently to said two housing walls.

11. The finned-tube heat transfer device according to claim 1, wherein said tubes extend transversely to the longitudinal direction of said housing through said first flow path and are arranged parallel next to one another both in the longitudinal direction and also the transverse direction of said housing.

12. The finned-tube heat transfer device according to claim 1, wherein the fluidic connections of said tubes are realized such that a plurality of parallel-connected tube groups are formed, each of said tube groups comprising a plurality of tubes connected in series.

13. A process for heat transfer comprising the steps of:

providing a finned-tube heat transfer device comprising a housing with longitudinal ends comprising a first inlet for a first fluid and a first outlet for the first fluid, said housing enclosing, in a circumferential direction, a longitudinal direction first flow path for the first fluid which is laterally delimited by a first wall structure and a second wall structure and a tube system forming a second flow path for a second fluid, said tube system comprising a second inlet for the second fluid and a second outlet for the second fluid, said tube system being arranged in said first flow path and being coupled in said housing to said first flow path in a heat transferring manner and said tube system comprising a multitude of tubes, which are parallel to one another, which extend between said first wall structure and said second wall structure and which are provided with fins within said first flow path, said tubes being arranged offset to one another transversely to a flow direction of said first fluid, said tubes being fluidically interconnected outside of said first flow path by a fluidic connection of said tubes effected within said first housing wall structure and said second housing wall structure, said first housing wall structure comprising a first one-piece outer housing wall and a first one-piece inner housing wall, said second wall structure comprising a second one-piece outer housing wall and a second one-piece inner housing wall, said first one-piece outer housing wall comprising a plurality of first connecting channel portions, said first connecting channel portions being diagonally arranged to form a diagonal arrangement of connecting channels, said plurality of first connecting channel portions being integrally connected to said first one-piece outer housing wall, said first connecting channel portions defining an outermost portion of said first one-piece outer housing wall, said second one-piece outer housing wall comprising a plurality of second connecting channel portions, each of said second connecting channel portions defining an outermost portion of said second one-piece outer housing wall, each of said second connecting channel portions being integrally connected to said second one-piece outer housing wall, each of said first connecting channel portions and each of said second connecting channel portions connecting an exit end of one of said tubes to an entry end of another one of said tubes, said second fluid inlet being formed on one of said first one-piece outer housing wall and said second one-piece outer housing wall, one of said first one-piece outer housing wall and said second one-piece outer housing wall and one of a portion of said first one-piece inner housing wall and a portion of said second one-piece inner housing wall defining a distribution chamber, which fluidically connects entry ends of a plurality of said tubes to said second inlet;

using said finned-tube heat transfer device as an exhaust gas heat transfer device or as an evaporator or as an exhaust gas recirculation cooler or as a charge air cooler or as a condenser or as a heater heat transfer device or as an evaporator or a condenser of an air-conditioning device or as an evaporator or as a condenser of a waste heat utilization device based on a Rankine cycle process.

14. A process for heat transfer comprising the steps of:

providing a finned-tube heat transfer device comprising a housing with longitudinal ends comprising a first inlet for a first fluid and a first outlet for the first fluid, said housing enclosing, in a circumferential direction, a longitudinal direction first flow path for the first fluid which is laterally delimited by a first housing wall structure and a second wall structure and a tube system forming a second flow path for a second fluid, said first wall structure comprising a first integrally formed one-piece housing outer wall and a first integrally formed one-piece housing inner wall, said second wall structure comprising a second integrally formed one-piece housing outer wall and a second integrally formed one-piece housing inner wall, said tube system comprising a second inlet for the second fluid and a second outlet for the second fluid, said tube system being arranged in said first flow path and being coupled in said housing to said first flow path in a heat transferring manner and said tube system comprising a multitude of tubes, which are parallel to one another, which extend between said first wall structure and said second wall structure and which are provided with fins within said first flow path, said tubes being fluidically interconnected outside of said first flow path by a fluidic connection of said tubes effected within said first housing wall structure and said second housing wall structure, said tubes being arranged offset to one another transversely to a flow direction of said first fluid, said first integrally formed one-piece housing outer wall comprising a first housing wall inner surface, said first housing wall inner surface extending continuously, without interruption, from one end of said first wall structure to another end of said first wall structure, said inner surface defining a plurality of first connecting channel portions, said first connecting channel portions being diagonally arranged to form a diagonal arrangement of connecting channels, each of said plurality of first connecting channel portions defining an outer periphery of said first wall structure, said second integrally formed one-piece housing outer wall comprising a second housing wall inner surface, said second housing wall inner surface extending continuously, without interruption, from one end of said second wall structure to another end of said second wall structure, said second housing wall inner surface defining a plurality of second connecting channel portions, each of said plurality of second connecting channel portions defining an outer periphery of said second wall structure, each of said first connecting channel portions and each of said second connecting channel portions connecting an exit end of one of said tubes to an entry end of another one of said tubes, said second fluid inlet being formed on one of said first integrally formed one-piece housing outer wall and said second integrally formed one-piece housing outer wall, said one of said first housing wall inner surface and said second housing wall inner surface and one of a portion of said first integrally formed one-piece housing inner wall and a portion of said second integrally formed one-piece housing inner wall defining a distribution chamber, which fluidically connects entry ends of a plurality of said tubes to said second fluid inlet;

connecting the finned-tube heat transfer device for transferring heat between the first fluid and the second fluid as part of an exhaust gas heat transfer device or as an evaporator or as an exhaust gas recirculation cooler or as an charge air cooler or as a condenser or as a heater heat transfer device or as an evaporator or a condenser of an air-conditioning device or as an evaporator or as condenser of a waste heat utilization device based on a Rankine cycle process.

15. A process in accordance with claim 14, wherein said second fluid outlet is formed on another one of said first integrally formed one-piece housing outer wall and said second integrally formed one-piece housing outer wall, wherein another one of said first housing wall inner surface and said second housing wall inner surface and another one of said portion of said first integrally formed one-piece housing inner wall and said portion of said second integrally formed one-piece housing inner wall define a collecting chamber, which fluidically connects exit ends of a plurality of said tubes to said second fluid outlet, said collecting chamber extending perpendicular to said first flow path, at least one of said plurality of first connecting channel portions being located at a spaced location from another one of said plurality of first connecting channel portions with respect to a first direction of said first housing outer wall, said at least one of said plurality of first connecting channel portions being located at a spaced location from yet another one of said plurality of first connecting channels portions with respect to a second direction of said first housing outer wall, said first direction being different from said second direction, at least one of said plurality of second connecting channel portions being located at a spaced location from another one of said plurality of second connecting channel portions with respect to a second housing outer wall first direction of said second housing outer wall, said at least one of said plurality of second connecting channel portions being located at a spaced location from yet another one of said plurality of second connecting channels portions with respect to a second housing outer wall second direction of said second housing outer wall, said second housing outer wall second direction being different from said second housing outer wall first direction.

16. A process in accordance with claim 15, wherein said first integrally formed one-piece housing outer wall comprises a plurality of flat portions, each of said flat portions being in direct contact with a portion of said first integrally formed one-piece housing inner wall, said second integrally formed one-piece housing outer wall comprising a plurality of second housing wall flat portions, each of said second housing wall flat portions being in direct contact with a portion of said second integrally formed one-piece housing inner wall, wherein a first planar portion of said first housing outer wall is located between each of said plurality of first connecting channel portions and said another one of said plurality of first connecting channel portions with respect to said first direction and a second planar portion of said first housing outer wall is located between each of said plurality of said first connecting channel portions and said yet another one of said plurality of first connecting channels portions with respect to said second direction, wherein a second housing outer wall first planar portion is located between each of said plurality of second connecting channel portions and said another one of said plurality of second connecting channel portions with respect to said second housing outer wall first direction and a second housing outer wall second planar portion is located between each of said plurality of second connecting channel portions and said yet another one of said plurality of second connecting channels portions with respect to said second housing outer wall second direction, wherein said distribution chamber extends in a direction orthogonal to said first flow path, said first flow path being parallel to a longitudinal direction of said first wall structure and said second wall structure.

17. A process in accordance with claim 13, wherein said second fluid outlet is formed on another one of said first one-piece outer housing wall and said second one-piece outer housing wall, said another one of said first one-piece outer housing wall and said second one-piece outer housing wall and another one of said portion of said first one-piece inner housing wall and said portion of said second one-piece inner housing wall a collecting chamber, which fluidically connects exit ends of a plurality of said tubes to said second fluid outlet, said collecting chamber extending perpendicular to said first flow path, at least one of said plurality of first connecting channel portions being located at a spaced location from another one of said plurality of first connecting channel portions in a first direction of said first housing outer wall, said at least one of said plurality of first connecting channel portions being located at a spaced location from yet another one of said plurality of first connecting channels portions in a second direction of said first housing outer wall, said first direction being different from said second direction, at least one of said plurality of second connecting channel portions being located at a spaced location from another one of said plurality of second connecting channel portions in a second housing outer wall first direction of said second housing outer wall, said at least one of said plurality of second connecting channel portions being located at a spaced location from yet another one of said plurality of second connecting channels portions with respect to a second housing outer wall second direction of said second housing outer wall, said second housing outer wall first direction being different from said second housing outer wall second direction.

18. A process in accordance with claim 17, wherein said first one-piece outer housing wall comprises a plurality of flat portions, each of said flat portions being in direct contact with a portion of said first one-piece inner housing wall, said second one-piece outer housing wall comprising a plurality of second housing wall flat portions, each of said second housing wall flat portions being in direct contact with a portion of said second one-piece inner housing wall, wherein a first planar portion of said first housing outer wall is located between each of said plurality of first connecting channel portions and said another one of said plurality of first connecting channel portions with respect to said first direction of said first housing outer wall and a second planar portion of said first housing outer wall is located between each of said plurality of said first connecting channel portions and said yet another one of said plurality of first connecting channels portions with respect to said second direction of said first housing outer wall, wherein a second housing outer wall first planar portion is located between each of said plurality of second connecting channel portions and said another one of said plurality of second connecting channel portions with respect to said second housing outer wall first direction and a second housing outer wall second planar portion is located between each of said plurality of second connecting channel portions and said yet another one of said plurality of second connecting channels portions with respect to said second housing outer wall second direction.

19. A process in accordance with claim 17, wherein said first wall structure is arranged on one side of said housing, said second wall structure being arranged on another side of said housing, wherein said distribution chamber extends in a direction orthogonal to said first flow path, said first flow path being parallel to a longitudinal direction of said first wall structure and said second wall structure.

* * * * *